US009004389B2

(12) United States Patent
Yen et al.

(10) Patent No.: US 9,004,389 B2
(45) Date of Patent: Apr. 14, 2015

(54) BOBBIN AND METHOD OF USING THE SAME

(75) Inventors: Chun-Ching Yen, Taoyuan Hsien (TW); Shih-Yun Chen, Taoyuan Hsien (TW); Cai-Li Gu, Taoyuan Hsien (TW); Tsa-Sheng Lin, Taoyuan Hsien (TW)

(73) Assignee: Delta Electronics, Inc., Taoyuan (TW)

( * ) Notice: Subject to any disclaimer, the term of this patent is extended or adjusted under 35 U.S.C. 154(b) by 279 days.

(21) Appl. No.: 13/467,750

(22) Filed: May 9, 2012

(65) Prior Publication Data

US 2013/0032657 A1 Feb. 7, 2013

(30) Foreign Application Priority Data

Aug. 3, 2011 (CN) ..... 2011 1 0221439

(51) Int. Cl.

| | |
|---|---|
| ***B21C 47/02*** | (2006.01) |
| ***B65H 81/06*** | (2006.01) |
| ***B65H 75/28*** | (2006.01) |
| ***H01F 5/04*** | (2006.01) |
| ***H01F 41/10*** | (2006.01) |

(52) U.S. Cl.

CPC ..... *B65H 75/28* (2013.01); *H01F 5/04* (2013.01); *H01F 41/10* (2013.01)

(58) Field of Classification Search

USPC ..... 242/587.1, 587.2, 587.3, 614, 614.1, 242/432.6, 433.4, 443, 445.1, 446

See application file for complete search history.

(56) References Cited

U.S. PATENT DOCUMENTS

| | | | | | |
|---|---|---|---|---|---|
| 3,214,108 | A | * | 10/1965 | Friedrich | 242/332.8 |
| 3,306,554 | A | * | 2/1967 | Henderson | 242/476.7 |
| 3,314,452 | A | * | 4/1967 | Cartwright et al. | 242/437.2 |
| 3,627,230 | A | * | 12/1971 | Wangerin | 242/332 |
| 4,709,873 | A | * | 12/1987 | Smith et al. | 242/332.8 |
| 5,544,827 | A | * | 8/1996 | Yano | 242/445.1 |
| 5,845,863 | A | * | 12/1998 | Takubo et al. | 242/437.1 |
| 6,029,925 | A | * | 2/2000 | Yano | 242/440.1 |
| 6,047,918 | A | | 4/2000 | Saito | |
| 6,786,445 | B1 | * | 9/2004 | Todd et al. | 242/548.2 |
| 2006/0049298 | A1 | * | 3/2006 | Arai et al. | 242/614 |
| 2011/0114781 | A1 | * | 5/2011 | Kimura et al. | 242/443 |

FOREIGN PATENT DOCUMENTS

| | | | |
|---|---|---|---|
| CA | 2114948 | A1 | 12/1993 |
| CN | 1109839 | A | 10/1995 |
| JP | 07-323964 | A | 12/1995 |
| JP | 08-245083 | A | 9/1996 |
| TW | 200744282 | A | 10/2007 |
| TW | 201118894 | A1 | 6/2011 |

* cited by examiner

*Primary Examiner* — Emmanuel M Marcelo
(74) *Attorney, Agent, or Firm* — Muncy, Geissler, Olds & Lowe, P.C.

(57) ABSTRACT

A bobbin is provided, which includes a main body, a first block board, a second block board, and at least one guiding member. The main body extends along an axis. The first block board and the second block board circumferentially surround ends of the main body and radially extend from the main body, respectively. The guiding member is formed on the first block board or the second block board and comprises a dummy pin, radially extending from the first block board or the second block board.

12 Claims, 9 Drawing Sheets

BOBBIN AND METHOD OF USING THE SAME

CROSS REFERENCE TO RELATED APPLICATIONS

This Application claims priority of China Patent Application No. 201110221439.3, filed on Aug. 3, 2011, the entirety of which is incorporated by reference herein.

BACKGROUND OF THE INVENTION

1. Field of the Invention

The invention relates to a bobbin, and more particularly, to a bobbin which has a guiding member for fixing electrical coils thereon.

2. Description of the Related Art

Electrical coils formed on hollow cylinder bobbins are well known in the prior art. Please refer to FIG. 1, for a conventional winding machine 10, wherein a connector 11 passes though structural center of a bobbin 20 so as to rotate the bobbin 20. Two block boards 21 and 22 are on each terminal of the bobbin 20, and a wire-winding region 23 is disposed between the two block boards 21 and 22.

While winding the electrical coils 30, a first terminal 31 of the electrical coil 20 is manually fixed on the winding machine 10 via a tape 40. Then, the bobbin 20 is rotated to wrap several turns of electrical coils 30 around the wire-winding region 23.

The above mentioned winding method is cumbersome, time consuming and economically unsatisfactory. In addition, since the winding of the electrical coils is manually accomplished, it is hard to control winding quality; thus, the quality of the products applying the bobbin cannot be stably maintained.

In this regard, a modified bobbin that may decrease the manual handling process, increase processing efficiency, reduce manufacturing cost, and improve product quality is provided in the present invention.

BRIEF SUMMARY OF THE INVENTION

To overcome the disadvantages of the prior art bobbin, the present invention provides a bobbin which lends itself more readily to coiling by automated techniques and to reducing the time involved in manual handling.

One embodiment of the invention is to provide a bobbin, which includes a main body, a first block board, a second block board, and at least one guiding member. The main body extends along an axis. The first block board and a second block board circumferentially surround ends of the main body and radially extend from the main body, respectively. The guiding member is formed on the first block board or the second block board and includes a dummy pin, radially extending from the first block board or the second block board.

The other embodiment of the invention is to provide a method of winding an electronic coil on the above mentioned bobbin, which includes providing a bobbin that comprises a guiding member; fixing a portion of the electronic coil to the guiding member; winding a desired amount of turns of the electronic coil on the bobbin; and guiding the electronic coil to the outside of the bobbin.

Still another embodiment of the invention is to provide a method of winding an electronic coil on the above mentioned bobbin, providing a bobbin that comprises two guiding members; fixing a first portion of the electronic coil to one of the guiding members; winding a desired amount of turns of the electronic coil on the bobbin; and fixing a second portion of the electronic coil to another guiding member.

In the present invention, due to the relationship of the guiding member and the wire-winding region of the bobbin, the step that fixes the electrical coil via a tape in the prior art can be eliminated. Therefore, not only the steps of winding can be simplified, but the time consumed for manually handing winding is reduced.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
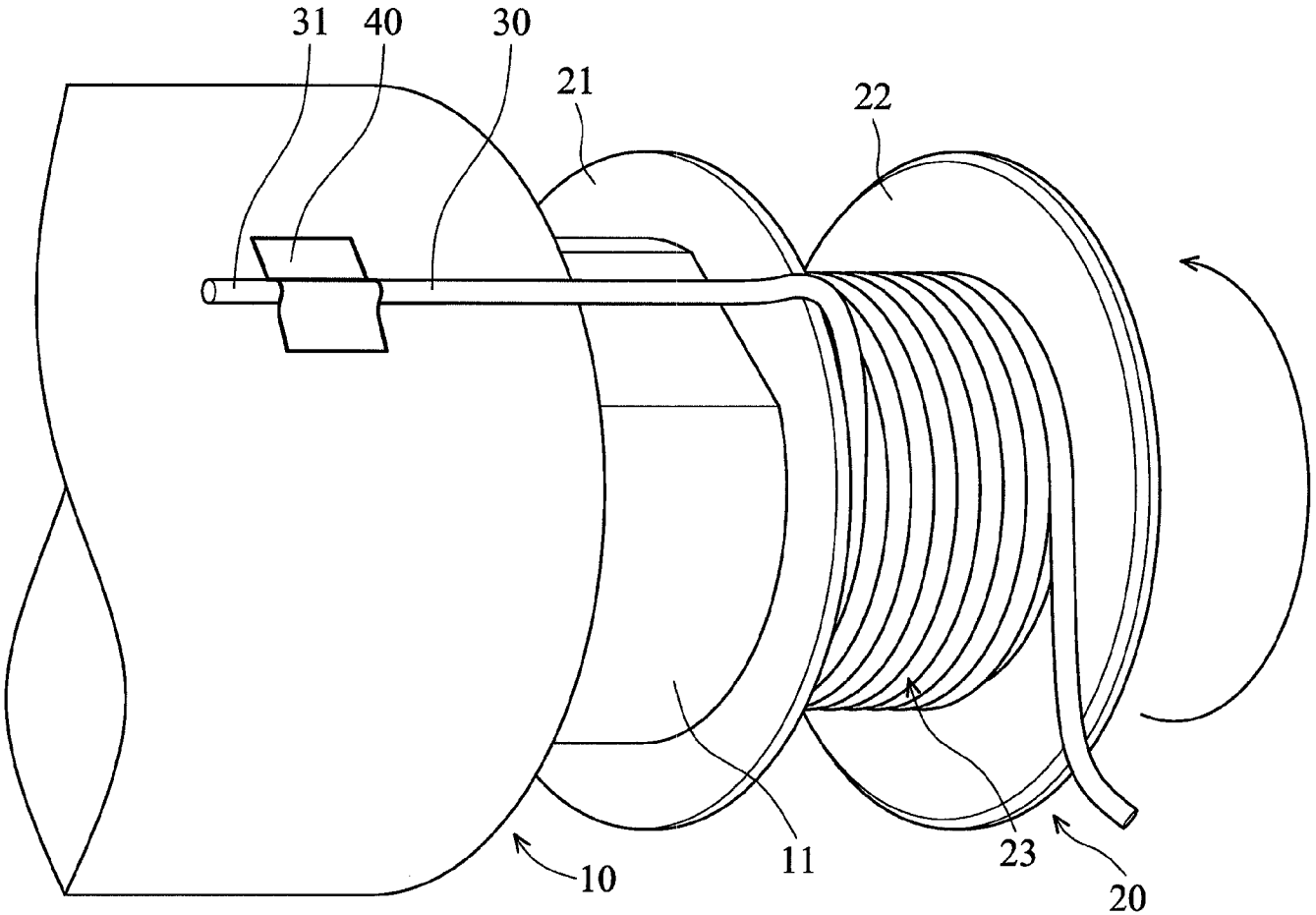
FIG. 1 depicts a schematic view of a conventional bobbin.

The following description is of the best-contemplated mode of carrying out the invention. This description is made for the purpose of illustrating the general principles of the invention and should not be taken in a limiting sense. The scope of the invention is best determined by reference to the appended claims Please refer to FIGS. 2A and 2B, wherein FIG. 2B depicts a sectional view showing the a-a section of a bobbin 100 observed along an axis C in FIG. 2A. The bobbin 100 of a first embodiment of the present invention includes a main body 110, a first block board 120, a second block board 130, a guiding member 140, an extension portion 150, and a plurality of conduction pins 155.

The main body 110 is a hollow cylinder and includes two ends 111 and 112 and a passage 113. The main body 110 extends along the axis C, and the two ends 111 and 112 are defined at two sides of the main body 110 along the axis C.

The first block board 120 circumferentially surrounds the end 111 of the main body 110 and radially extends therefrom. The second block board 130 circumferentially surrounds the end 112 of the main body 110 and radially extends therefrom. The circumferences of the first block board 120 and the second block board 130 are formed in a circular shape. A wire-winding region 114 for winding is defined among the surface of the main body 110, the first block board 120, and the second block board 130.

Please refer to FIG. 2B. The guiding member 140 is formed on the first block board 120 and includes a dummy pin 141 and a notch 143. The dummy pin 141 includes a base portion 141*a* and a distal end 141*b*, wherein the base portion 141*a* is connected to the circumference 121 of the first block board 120 and radially extends to the distal end 141*b* in an outward direction. In an exemplary embodiment, the dummy pin 141 is a rectangular column (FIG. 2A), whereby facilitating the electrical coil winding thereon, but the shape of the dummy pin 141 should not be limited thereto. The dummy pin 141 can also be a round column, or other similar column.

The notch 143 is formed on the first block board 120. Specifically, the notch 143, essentially in a U-shape, is adjacent to the dummy pin 141 and depressed from the circumference 121 of the first block board 120. A lateral side 143*a* of the opening edge of the notch 143 is connected to the lateral side 141*c* of the base portion 141*a* of the dummy pin 141, and the bottom surface 143*b* of the notch 143 is directly connected to the surface 115 of the main body 110, whereby the electrical coil 30 (FIG. 3) can be guided into the wire-winding region 114. In addition, the interior surface 122 of the first block board 120 and the lateral surface 141*d* of the dummy pin 141 which is close to the main body 110 are coplanar.

Figure 2A:
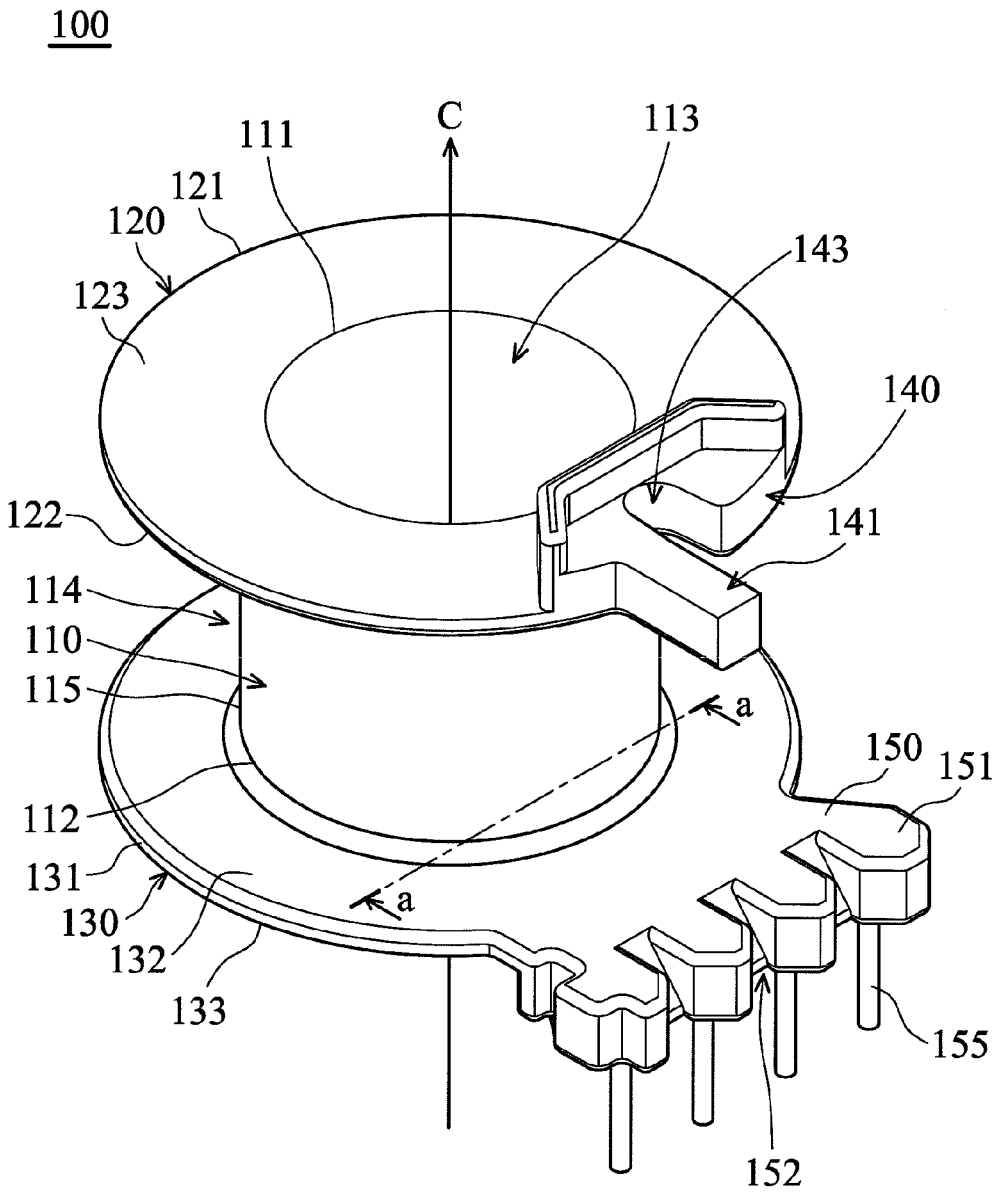
FIG. 2A depicts a schematic view of a bobbin in accordance with a first embodiment of the present invention.
Figure 2B:
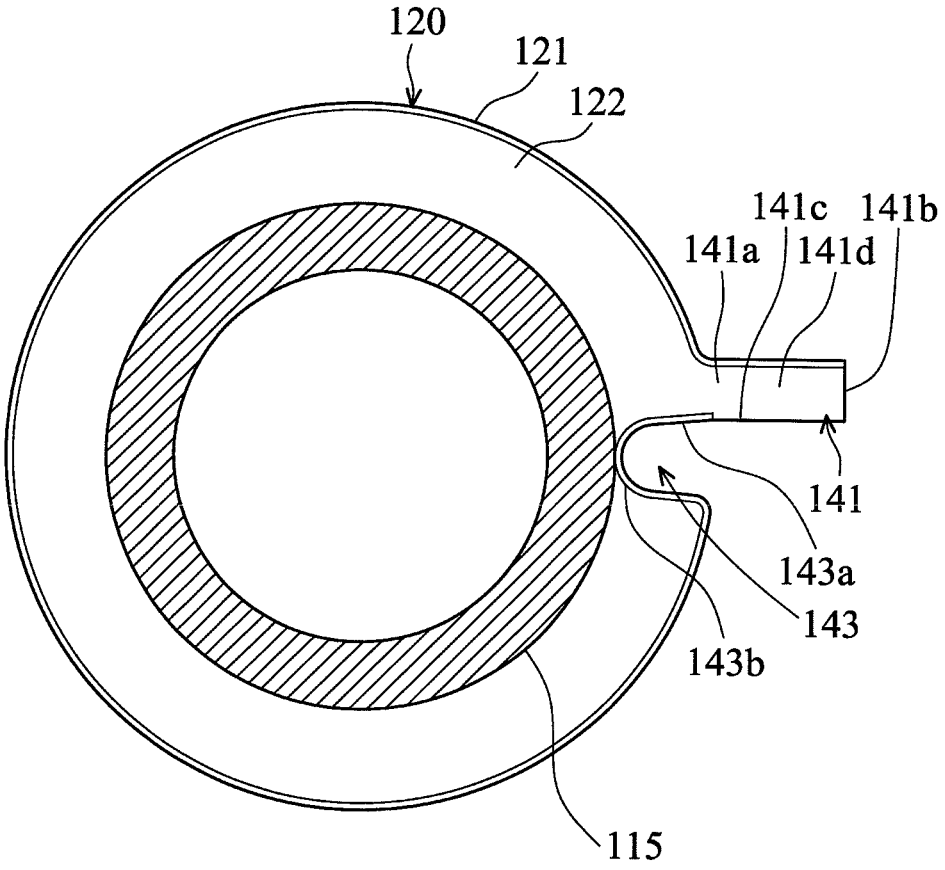
FIG. 2B depicts a sectional view showing the a-a section of the bobbin observed along an axis C in FIG. 2A.

Please refer to FIG. 2A. Corresponding to the position of the guiding member 140, the extension portion 150 extends from the second block board 130. Four projections 151 are formed at the distal end of the extension portion 150, and a holding slot 152 is formed between each two of the projections 151. Four conducting pins 155, adjacent to the holding slots 152, are respectively disposed on the bottom surface of the projection 151. The conducting pins 155 are conductors to connect with a circuit board (not shown in the figure).

The main body 110, the first block board 120, the second block board 130, the guiding member 140 and the extension portion 150 are integrally formed by a plastic material. The conducting pins 155 are embedded into the projections 151 of the extension portion 150.

Figure 3:
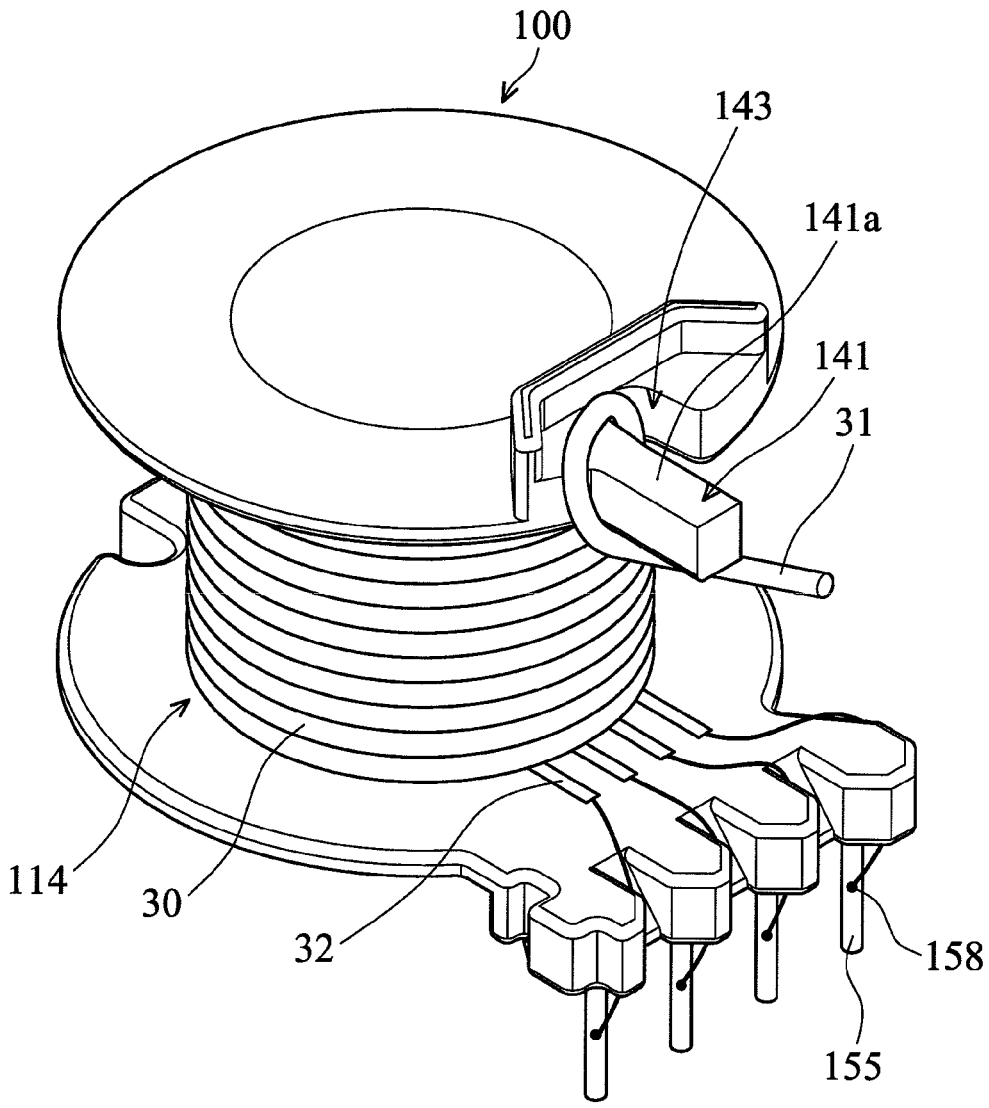
FIG. 3 depicts a schematic view of the bobbin of the first embodiment which has an electrical coil wound thereon.

Please refer to FIG. 3. In one exemplary embodiment, the electrical coil 30 is wound on the bobbin 100 by the method that follows: Firstly, the first terminal 31 of the electrical coil 30 is led though the notch 143 and encircle the base portion 141*a* of the dummy pin 141, whereby the first terminal 31 of the electrical coil 30 is firmly hooked on the guiding member 140. Next, the bobbin 100 is rotated for a desired amount of turns manually or automatically so as to wind the electrical coil 30 on the wire-winding region 114. Third, the electrical coil 30 is guided to the outside of the bobbin 100. Fourth, the second terminal 32 of the electrical coil 30 is severed and anchored to the conducting pins 155 by soldering. Last, the first terminal 31 of the electrical coil 30 is removed from the guiding member 140.

It is noted that the steps of winding the electrical coil 30 should not be limited. For example, winding the electrical coil on the bobbin 100 can also be as follows. First, the second terminal 32 of the electrical coil 30 is anchored to the conducting pins 155. Next, the bobbin 100 is rotated for a desired amount of turns manually or automatically so as to wind the electrical coil 30 on the wire-winding region 114. Third, the electrical coil 30 is fixed on the guiding member 140. Fourth, the electrical coil 30 is guided to the outside of the bobbin 100. Last, the first terminal 31 of the electrical coil 30 is severed, and the first terminal 32 of the electrical coil 30 is removed from the guiding member 140.

Figure 4A:
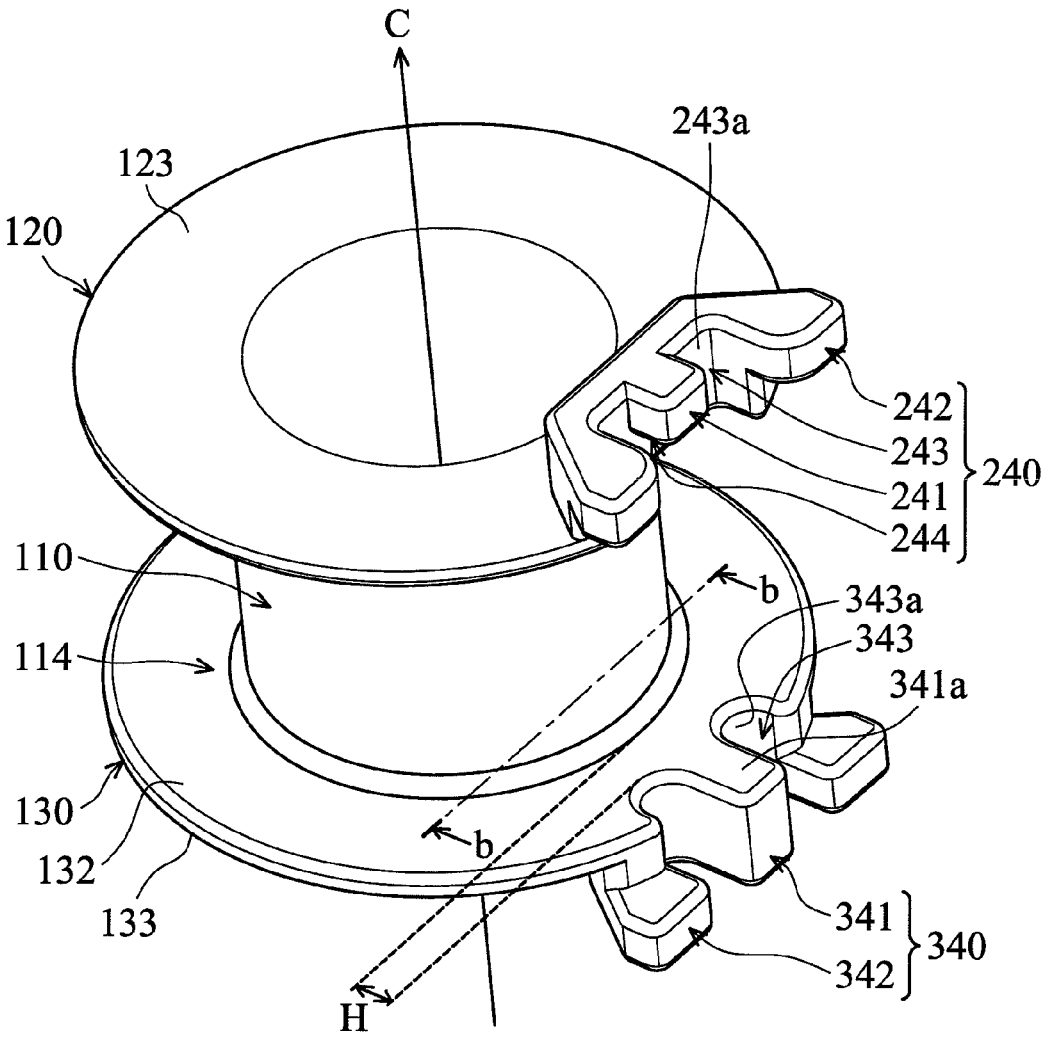
FIG. 4A depicts a schematic view of a bobbin in accordance with a second embodiment of the present invention.

Please refer to FIG. 4A. A bobbin 100' of a second embodiment of the present invention includes a main body 110, a first block board 120, a second block board 130, guiding members 240 and 340. The structural feature of the main body 110, the first block board 120 and the second block board 130 are similar to that of the first embodiment, and the structural features are not described again for simplification.

The guiding member 240 is projected from the exterior surface 123 of the first block board 120. The guiding member 240 includes a lump 241, two dummy pins 242, and two notches 243. The lump 241 is disposed on the substantial center of the guiding member 240 and radially extends in an outward direction. The two dummy pins 242 are disposed on two sides of the lump 241 and radially extends in an outward direction. Along a direction away from the lump 241, the width of the dummy pins 242 increases. The notches 243 are respectively formed between the lump 241 and the two dummy pins 242, and a passage 244 are formed among the two notches 243 and the lump 241, which allows the electrical coil 30 (FIG. 5) to pass therethrough.

Figure 4B:
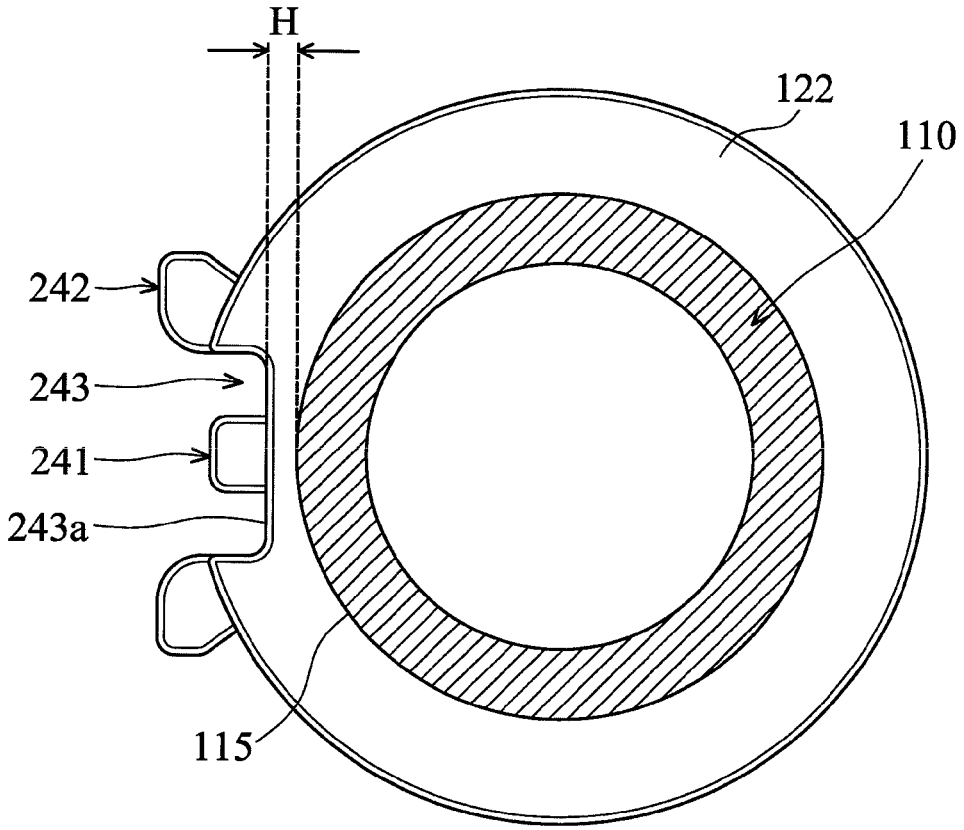
FIG. 4B depicts a sectional view of the b-b section of the bobbin which is observed along the axis C in FIG. 4A.

Please refer to FIG. 4B, which depicts a sectional view of the b-b section of the bobbin 100' observed along the axis C in FIG. 4A. A space H is formed between the bottom surface 243*a* of the notches 243 and the surface 115 of the main body 110, wherein the bottom surface 243*a* is a plane.

Figure 4C:
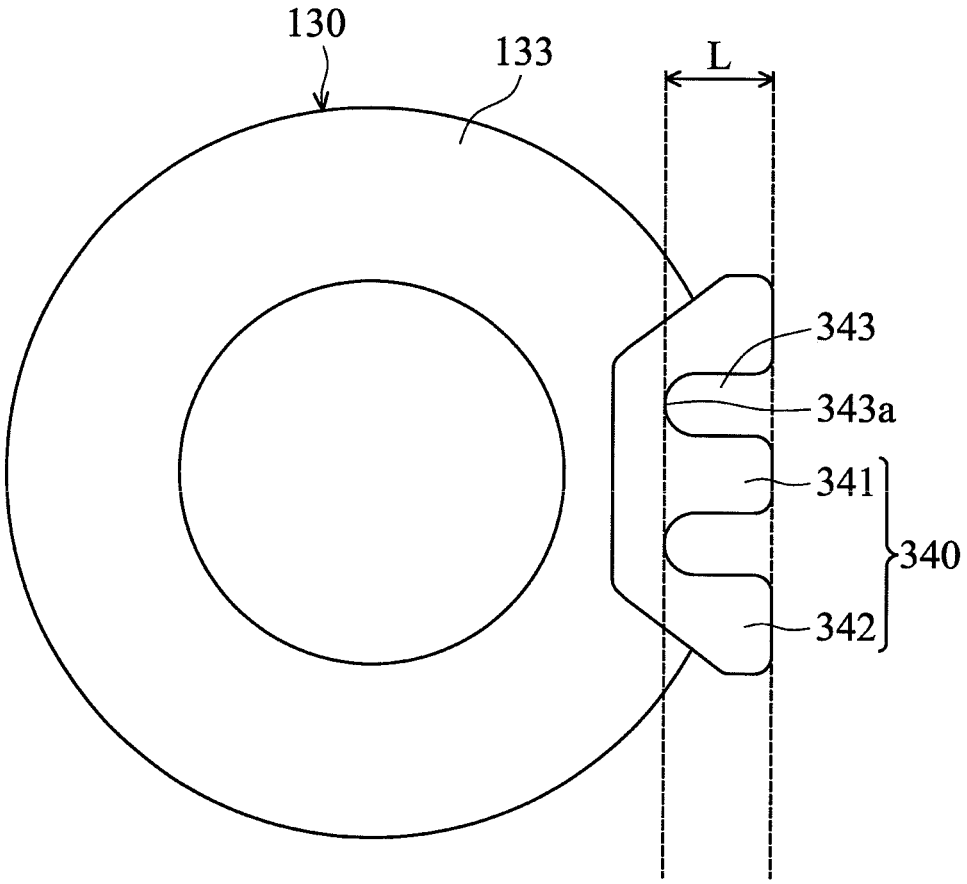
FIG. 4C depicts a bottom view of the bobbin in FIG. 4A.

Please refer to FIG. 4A. Corresponding to the position of the guiding member 240, the guiding member 340 is projected from the exterior surface 133 of the second block board 130 along a reverse direction of the axis C. The structural feature of the guiding member 240 is similar to that of the guiding member 340. The differences existing therebetween are that the lateral surface 341*a* of the lump 341 and the interior surface 132 of the second block board 130 are coplanar; thus, there is no structure similar to the passage 244 of the guiding member 240. In addition, the bottom surface 343*a* of the notch 343 is a curved plane, and the lump radially extends a length L (FIG. 4C), which is the same as the extending length L of the dummy pin 342.

Figure 5:
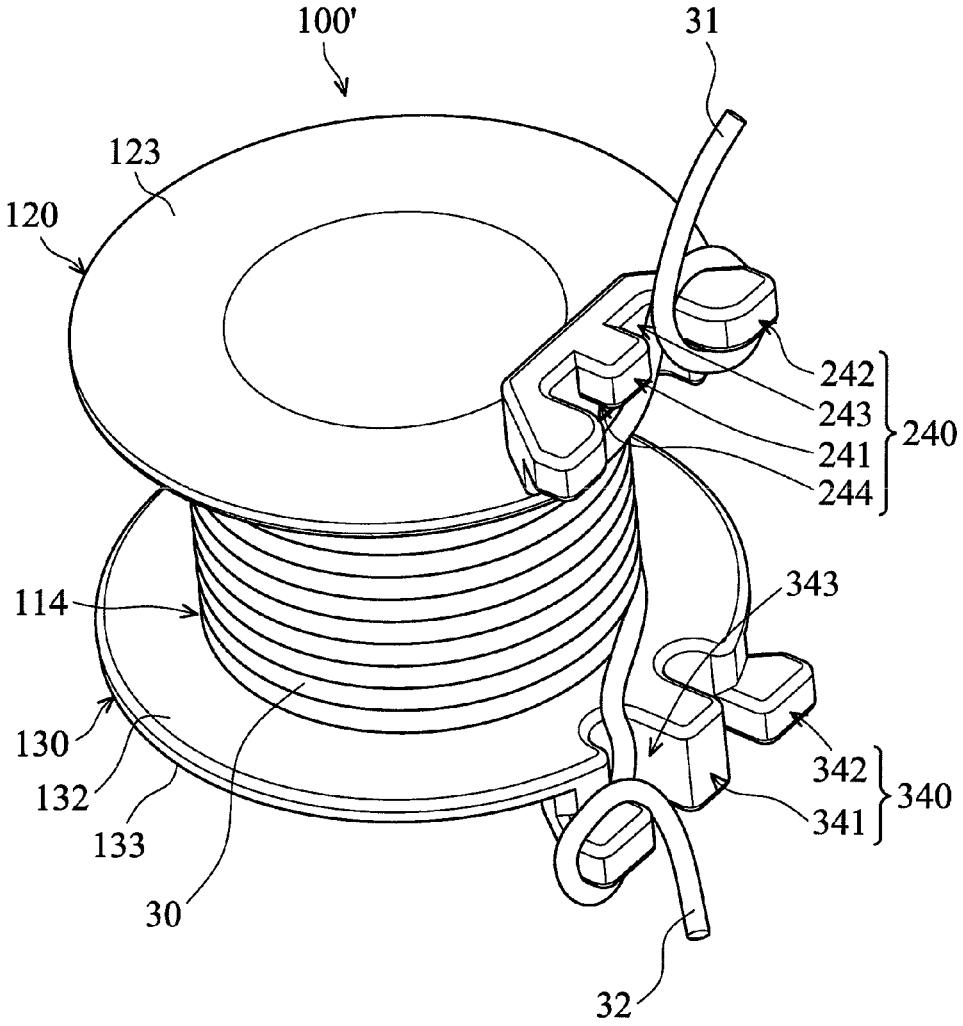
FIG. 5 depicts a schematic view of the bobbin of the second embodiment which has an electrical coil wound thereon.

Please refer to FIG. 5. In one exemplary embodiment, the electrical coil 30 is wound on the bobbin 100' by the method that follows; Firstly, the first terminal 31 of the electrical coil 30 is led though the notch 243 and encircles the dummy pin 242, whereby the first terminal 31 of the electrical coil 30 is firmly hooked on the guiding member 240. Next, the electrical coil 30 is led through the passage 244 of the guiding member 240, and the bobbin 100' is rotated for a desired amount of turns manually or automatically so as to wind the electrical coil 30 on the wire-winding region 114. Third, the electrical coil 30 is lead through the notch 343, and encircles the dummy pin 342, whereby the electrical coil 30 is firmly hooked on the guiding member 340. Fourth, the electrical coil 30 is guided to the outside of the bobbin 100'. Fifth, the second terminal 32 of the electrical coil 30 is severed. Last, the first terminal 31 and the second terminal 32 of the electrical coil 30 are removed from the guiding member 240 and the guiding member 340 respectively.

It is noted that the order of the steps of winding the electrical coil 30 should not be limited. For example, winding the electrical coil 30 on the bobbin 100' can also be as follows. Firstly, the second terminal 32 of the electrical coil 30 is fixed on the guiding member 340. Next, the bobbin 100' is rotated for a desired amount of turns manually or automatically so as to wind the electrical coil 30 on the wire-winding region 114. Third, the electrical coil 30 is fixed on the guiding member 240. Fourth, the electrical coil 30 is guided to the outside of the bobbin 100'. Fifth, the first terminal 32 of the electrical coil 30 is severed. Last, the first terminal 31 and the second terminal 32 of the electrical coil 30 are removed from the guiding member 240 and the guiding member 340 respectively.

Figure 6:
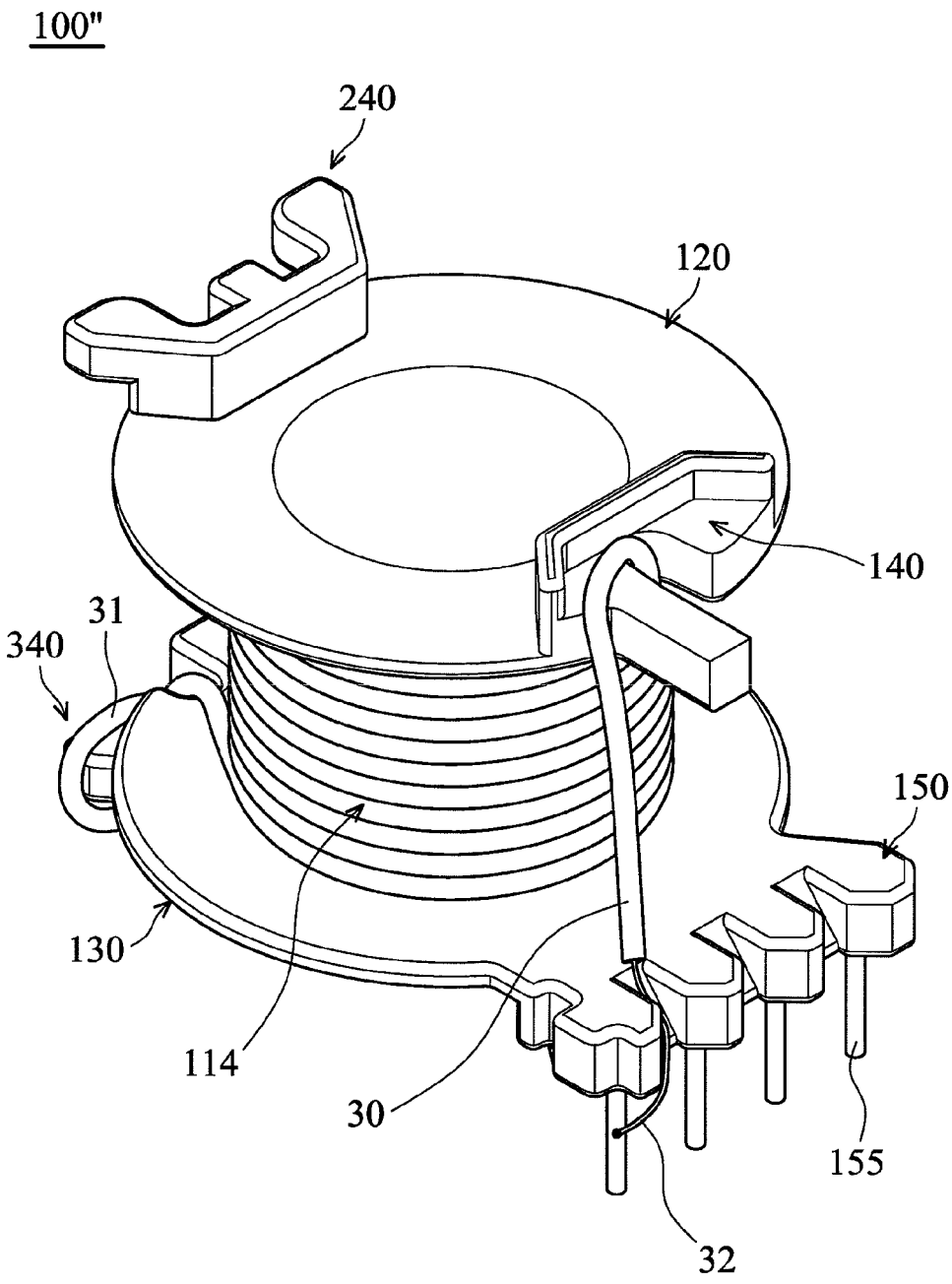
FIG. 6 depicts a schematic view of a bobbin of a third embodiment which has an electrical coil wound thereon.

Please refer to FIG. 6. A bobbin 100" of a third embodiment of the present invention includes a main body 110, a first block board 120, a second block board 130, a guiding member 140, a extension portion 150, a plurality of conducting pins 155, a guiding member 240 and a guiding member 340. The guiding member 140 is formed on the first block board 120. Corresponding to the guiding member 140 the extension portion 150 is disposed on the second block board 130. The conducting pins 155 are disposed on the extension portion 150. Opposite to the position of the guiding member 140, the guiding member 240 is formed on the first block board 120, and the guiding member 340 is corresponding to the second guiding member 240 and formed on the second block board 130.

In one exemplary embodiment, the electrical coil 30 is wound on the bobbin 100" by the method that follows: Firstly, the first terminal 31 of the electrical coil 30 is fixed on the guiding member 340. Second, the bobbin 100" rotated a desired amount of turns manually or automatically so as to wind the electrical coil 30 on the wire-winding region 114. Third, the electrical coil 30 is encircled around the guiding member 140. Fourth, the electrical coil 30 is guided to the outside of the bobbin 100". Fifth, the second terminal 32 of the electrical coil 30 is severed and the second terminal 32 of the electrical coil 30 is anchored to the conducting pins 155.

In the case that the bobbin 100" is applied to a transformer, the primary winding (not shown in figure) can be wound on the guiding member 140 and guided to the outside of the bobbin 100" through the extension portion 150 and the conducting pins 155; and the secondary winding (not shown in figure) can be wound on the guiding member 240 and guided to outside of the bobbin 100" through the guiding member 340.

It is noted that the structure of the bobbin of the present invention should not be limited to above embodiments, and a person skilled in the art can change the number of the guiding members or the positions where the guiding members are disposed as required. For example, the guiding members 140, 240, and 340 are formed on the first block board 120 or the second block board 130. In the other embodiments, one of the guiding members 140 and the guiding member 340 are formed on the first block board 120, and another guiding member 140 and the guiding member 240 are formed on the second block board 130. The distance between the guiding members formed on the same block board should not be limited, the guiding members can be arranged adjacently, separately or corresponding to each other.

Moreover, it is appreciated that the steps and methods of winding the electrical coil on the bobbin 100, 100', and 100" are presented here for the purpose of illustration only. It is not intended to be limited to the above embodiments.

Through the structural features of the guiding member, the bobbin of the present invention allows the terminals of the electrical coil to be directly fixed thereon, which overcomes the disadvantage of the prior art bobbin wherein the terminals of the electrical coil are attached to the winding machine. Therefore, the manual handling process can be reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bobbin, comprising:

a main body, extending along an axis;

a first block board and a second block board, circumferentially surrounding ends of the main body and radially extending from the main body, respectively; and at least one guiding member, formed on the first block board or the second block board and comprising a dummy pin, radially extending from the first block board or the second block board, wherein a notch is formed immediately adjacent to the dummy pin, and a lateral side of the dummy pin is connected to an inner wall of the notch, wherein a continuously curved surface extents from the lateral side of the dummy pin to the inner wall of the notch.

2. The bobbin as claimed in claim 1, wherein the notch is depressed from the circumference of the first block board or the second block board.

3. The bobbin as claimed in claim 2, wherein the at least one guiding member comprises two or more than two dummy pins and notches, and the guiding member further comprises a lump, wherein the notches are formed between the lump and one of the dummy pins.

4. The bobbin as claimed in claim 1 comprising two or more than two guiding members, wherein all of the guiding members are disposed on the first block board or the second block board, or the guiding members are respectively disposed on the first block board and the second block board.

5. The bobbin as claimed in claim 1, wherein the guiding member is projected outwardly from an exterior surface of the first block board that is away from the main body.

6. The bobbin as claimed in claim 1, wherein the continuously curved surface is connected to a surface of the main body.

7. A method of winding an electronic coil on a bobbin, comprising steps of:

providing a bobbin that comprises a guiding member, wherein the guiding member comprises a dummy pin and a notch formed immediately adjacent to the dummy pin, wherein a lateral side of the dummy pin is connected to an inner wall of the notch, and a continuously curved surface extends from the lateral side of the dummy pin to the inner wall of the notch;

fixing the electronic coil to the dummy pin and guiding the electronic coil passing through the notch;

winding a desired amount of turns of the electronic coil on the bobbin; and guiding the electronic coil to the outside of the bobbin.

8. The method of winding an electronic coil on the bobbin as claimed in claim 7, wherein the guiding member is comprised of an insulation material, and after the electronic coil is wound on the bobbin, the portion of the electronic coil fixed on the guiding member is removed from the guiding member.

9. The method of winding an electronic coil on the bobbin as claimed in claim 7, wherein the bobbin further comprises a conduction pin, and the electronic coil is connected to the conduction pin by soldering.

10. A method of winding an electronic coil on a bobbin, comprising:

providing a bobbin that comprises two guiding members, wherein each of the two guiding members comprises a dummy pin and a notch formed immediately adjacent to the dummy pin, wherein a lateral side of the dummy pin is connected to an inner wall of the notch, and a continuously curved surface extends from the lateral side of the dummy pin to the inner wall of the notch;

fixing a first portion of the electronic coil to one of the dummy pins and guiding the electronic coil passing through the corresponding notch;

winding a desired amount of turns of the electronic coil on the bobbin; and fixing a second portion of the electronic coil to another dummy pin and guiding the electronic coil passing through the corresponding notch.

11. The method of winding an electronic coil on the bobbin as claimed in claim 10, wherein the guiding member is comprised of an insulation material, and after the electronic coil is wound on the bobbin, the first portion and the second portion of the electronic coil are removed from the guiding member.

12. The method of winding an electronic coil on the bobbin as claimed in claim 10, wherein the bobbin further comprises a conduction pin, and the electronic coil is connected to the conduction pin by soldering.

* * * * *